US009420926B2

(12) United States Patent
Chun et al.

(10) Patent No.: US 9,420,926 B2
(45) Date of Patent: Aug. 23, 2016

(54) VACUUM CLEANER

(71) Applicant: SAMSUNG ELECTRONICS CO., LTD., Suwon-si, Gyeonggi-do (KR)

(72) Inventors: Dong Won Chun, Seoul (KR); Yeon Young Nam, Goyang-si (KR); Deok Sang Yun, Ansan-si (KR); Hwan Woong Choi, Seoul (KR); Yu Na Park, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 156 days.

(21) Appl. No.: 14/189,397

(22) Filed: Feb. 25, 2014

(65) Prior Publication Data

US 2014/0366315 A1 Dec. 18, 2014

(30) Foreign Application Priority Data

Jun. 12, 2013 (KR) ..... 10-2013-0067002

(51) Int. Cl.

| | |
|---|---|
| ***A47L 5/00*** | (2006.01) |
| ***A47L 9/00*** | (2006.01) |
| ***A47L 5/36*** | (2006.01) |
| ***A47L 5/22*** | (2006.01) |
| ***A47L 5/28*** | (2006.01) |

(52) U.S. Cl.

CPC ..... *A47L 9/009* (2013.01); *A47L 5/225* (2013.01); *A47L 5/28* (2013.01); *A47L 5/362* (2013.01)

(58) Field of Classification Search

CPC ..... A47L 5/28; A47L 5/36; A47L 5/225; A47L 5/362; A47L 9/009

USPC ..... 15/411

IPC ..... A47L 5/00

See application file for complete search history.

(56) References Cited

U.S. PATENT DOCUMENTS

| | | | | |
|---|---|---|---|---|
| 5,144,716 | A | 9/1992 | Watanabe et al. | |
| 2005/0108849 | A1 | 5/2005 | Lam | |
| 2006/0085943 | A1 | 4/2006 | Gammack et al. | |
| 2009/0165242 | A1 | 7/2009 | Lee et al. | |
| 2011/0219569 | A1 * | 9/2011 | Vines | A47L 5/28 15/340.2 |
| 2012/0079679 | A1 * | 4/2012 | Seo | A47L 9/009 15/415.1 |
| 2012/0090105 | A1 * | 4/2012 | Henderson | A47L 5/28 15/3 |

FOREIGN PATENT DOCUMENTS

| | | |
|---|---|---|
| EP | 2 368 472 | 9/2011 |

OTHER PUBLICATIONS

International Search Report issued Sep. 29, 2014 in corresponding International Patent Application No. PCT/KR2014/005069.

* cited by examiner

*Primary Examiner* — David Redding

(74) *Attorney, Agent, or Firm* — Staas & Halsey LLP

(57) ABSTRACT

A vacuum cleaner includes a main body including a fan motor to generate suction force, a suction unit connected to the main body to suction foreign matter from a surface to be cleaned in a state of contacting the surface, a dust collector separatably mounted to the main body to separate and collect foreign matter from air suctioned by the suction unit, and a wheel assembly to move the main body, wherein the main body is rotatable independently of the wheel assembly such that the main body rotates to change a movement direction thereof and the main body is moved in the changed direction by the wheel assembly.

32 Claims, 20 Drawing Sheets

VACUUM CLEANER

CROSS-REFERENCE TO RELATED APPLICATIONS

This application claims the benefit of Korean Patent Application No. 10-2013-0067002, filed on Jun. 12, 2013 in the Korean Intellectual Property Office, the disclosure of which is incorporated herein by reference.

BACKGROUND

1. Field

One or more embodiments relate to a vacuum cleaner that smoothly performs straight movement and direction change.

2. Description of the Related Art

A vacuum cleaner is a device that suctions air using suction force generated by a fan and a motor and filters foreign matter from the suctioned air to perform cleaning.

The vacuum cleaner includes a dust collector to filter foreign matter from the suctioned air using a predetermined filtering device. A porous filter unit to forcibly filter foreign matter from air when the air passes through a porous filter or a cyclone type dust collection unit to filter foreign matter from air during cyclonic flow of the air may be used as the filtering device.

The vacuum cleaner includes a main body including a dust collector to separate and collect foreign matter from air, a suction nozzle assembly to suction foreign matter, such as dust, from a floor while moving along the floor, and a connection pipe to guide the foreign matter suctioned by the suction nozzle assembly to the main body.

The suction nozzle assembly includes a suction head, a handle pipe, and an extension pipe connected between the handle pipe and the suction head. The suction head may suction foreign matter from a surface to be cleaned while contacting the surface. The handle pipe is connected to the suction head for user manipulation. The handle pipe and the suction head are connected to each other via the extension pipe. A user may perform cleaning while holding the handle pipe connected to the suction head.

The main body and the suction nozzle assembly may be connected to each other via the connection pipe. One side of the connection pipe may be connected to the suction nozzle assembly and the other side of the connection pipe may be connected to the main body. A flexible hose may be used as the connection pipe.

The main body includes an air suction device to generate suction force. The vacuum cleaner is provided at one side thereof with a dust collection container mounting unit, to which a dust collection container is mounted. The main body may be provided with a wheel assembly to move the main body.

In a conventional vacuum cleaner, traveling wheels are provided at opposite sides of the rear of the main body and a caster to change the direction of the main body is provided at the front of the bottom of the main body. In this case, although the direction of the main body is abruptly changed by a user, the traveling direction of the traveling wheels is not changed accordingly. As a result, the main body may be forcibly moved in a state in which the traveling wheels are lifted from the floor or the main body may overturn.

In a case in which the wheel assembly includes only a caster rotatable in all directions, on the other hand, the main body may shake even during straight movement of the main body with the result that the main body may collide with a wall or furniture in a room. In addition, when a carpet is cleaned, the main body may not easily travel on the carpet due to a long pile of the carpet.

SUMMARY

The foregoing described problems may be overcome and/or other aspects may be achieved by one or more embodiments of a vacuum cleaner configured such that a main body first may rotate independently of a wheel assembly during a change in direction of the vacuum cleaner and then the wheel assembly may rotate in a direction in which the main body is directed, thereby changing a movement direction of the main body while possibly improving straight mobility of the main body due to wheels.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a vacuum cleaner may include a main body including a fan motor to generate suction force, a suction unit connected to the main body to suction foreign matter from a surface to be cleaned when contacting the surface, a dust collector separatably mounted to the main body to separate and collect foreign matter from air suctioned by the suction unit, and a wheel assembly to move the main body, wherein the main body may be rotatable independently of the wheel assembly such that the main body may rotate to change a movement direction thereof and the main body may be moved in the changed direction by the wheel assembly.

The vacuum cleaner may further include an elastic member disposed between the wheel assembly and the main body, wherein, when the main body first rotates to change the movement direction thereof, a direction of the wheel assembly may be changed by elastic force of the elastic member.

The wheel assembly may include frames provided at an upper part, a lower part, and left and right sides of the main body and wheels rotatably mounted to the frames, the wheels being provided at opposite sides of the main body.

The frame provided at the lower part of the main body may be provided with a first rotation guide in a protruding state.

The main body may be provided at the bottom thereof with a receiving unit to receive the first rotation guide.

The receiving unit may be provided at the inside thereof with a second rotation guide in a protruding state, the second rotation guide functioning as a rotary shaft of the main body.

The frame provided at the lower part of the main body may be provided with a guide-receiving groove, into which the second rotation guide may be inserted.

The guide-receiving groove may be formed at the first rotation guide and the second rotation guide may be rotatably inserted into the guide-receiving groove.

The receiving unit may be formed at the bottom of the main body such that the receiving unit may extend backward and forward.

The frame provided at the lower part of the main body may be provided with an elastic member.

The main body may be provided at the bottom thereof with a pressing unit to press the elastic member.

The pressing unit may press the elastic member when the main body rotates to change the movement direction thereof.

The wheel assembly may be rotated in a direction in which the main body is directed by elastic force of the elastic member.

The frame provided at the lower part of the main body may be provided with an elastic member mounting unit to receive the elastic member.

The elastic member mounting unit may be provided at the side thereof with a hole, through which the pressing unit may press the elastic member.

The pressing unit may be provided in a receiving unit formed at the bottom of the main body.

The inside of the receiving unit may interfere with the elastic member mounting unit or a stopper provided at the frame provided at the lower part of the main body to restrict a rotational angle of the main body.

The vacuum cleaner may further include a handle connected to the upper side of the main body such that the handle is perpendicular to the main body, wherein the suction unit may be directly connected to one side of the main body.

The main body may be provided at the bottom thereof with a first rotation guide that may extend toward the left and right sides of the main body.

The frame provided at the lower part of the main body may be provided with a second rotation guide to guide movement of the first rotation guide.

When the main body rotates according to manipulation of the handle, the suction unit may rotate along with the main body.

When the main body rotates, the first rotation guide may move in the rotated direction along the second rotation guide.

When the main body rotates to change the movement direction thereof, the movement direction of the wheel assembly may be changed to move the main body.

The main body may be rotatable within a range of 10 to 15 degrees.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
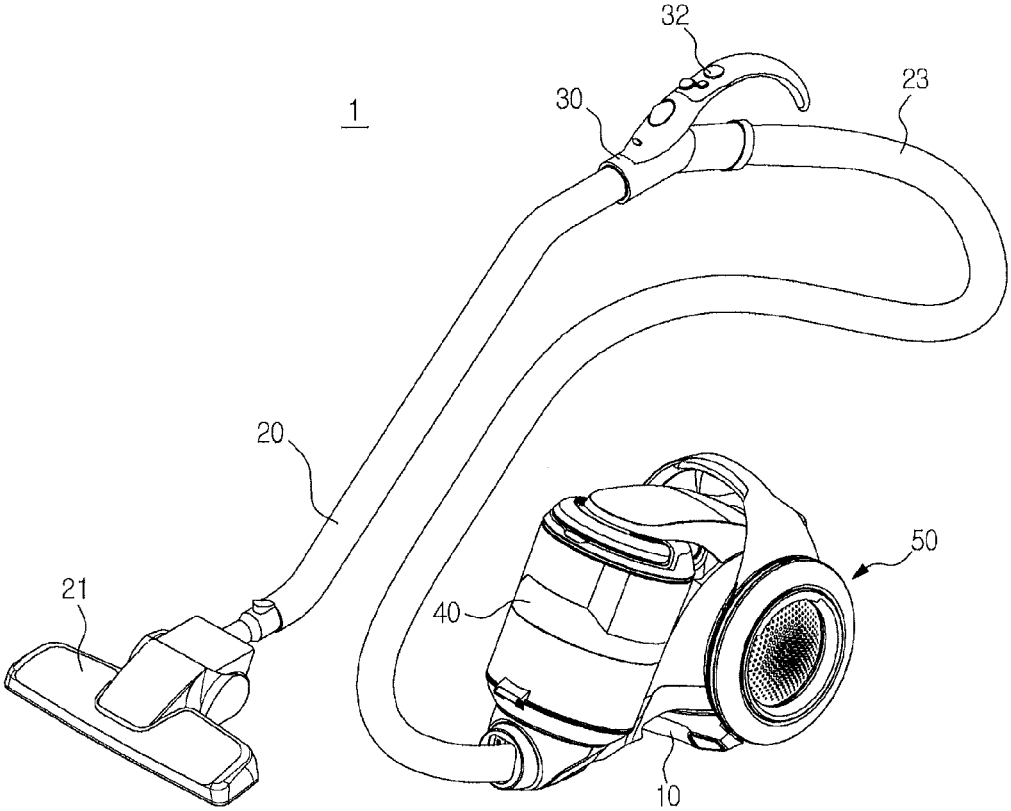
FIG. 1 is a view showing a vacuum cleaner according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
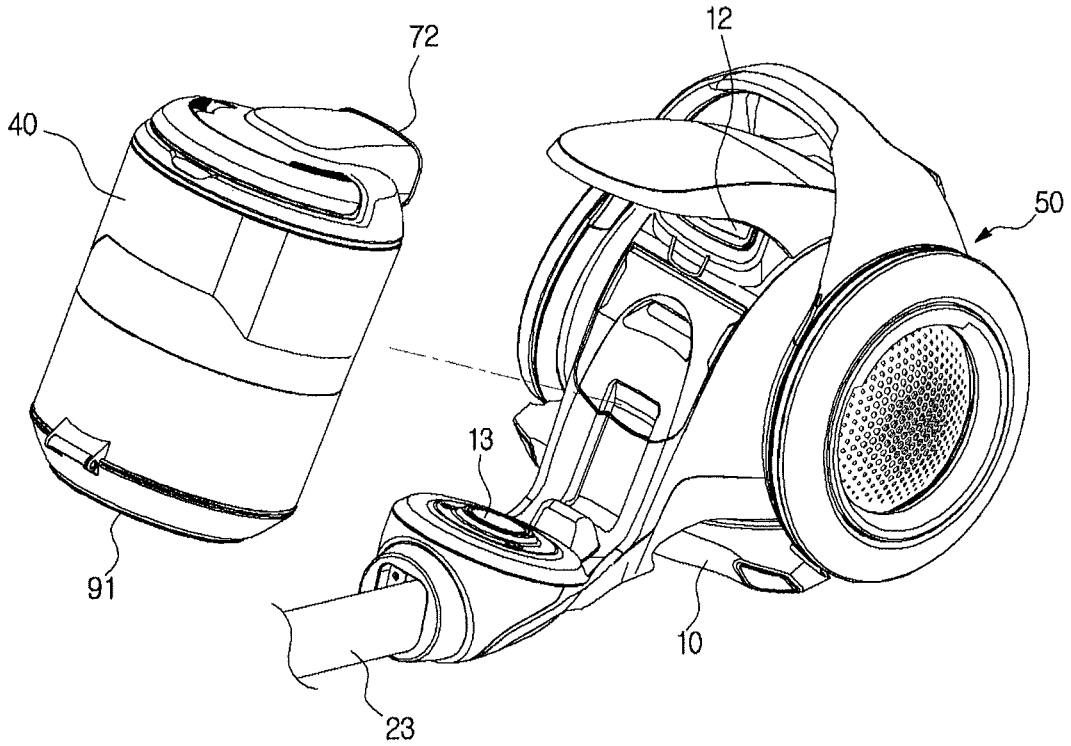
FIG. 2 is a view showing a state in which a dust collector is separated from a main body according to one or more embodiments.

FIG. 1 is a view showing a vacuum cleaner according to one or more embodiments and FIG. 2 is a view showing a state in which a dust collector is separated from a main body according to one or more embodiments.

Referring to FIGS. 1 and 2, a vacuum cleaner 1 according to one or more embodiments may include a main body 10, a dust collector 40, a suction unit 21, and a wheel assembly 50. The dust collector 40 and the wheel assembly 50 may be mounted to the main body 10. The suction unit 21 may contact a surface to be cleaned to suction foreign matter from the surface. The vacuum cleaner 1 according to one or more embodiments may be a canister type vacuum cleaner.

The main body 10 may include a fan motor (not shown) to generate suction force. The suction unit 21 may suction air from the surface, including dust contained in the air, using suction force generated by the main body 10. The suction unit 21 may be formed in a wide shape such that the suction unit 21 may tightly contact the surface.

Between the main body 10 and the suction unit 21 may be provided an extension pipe 20, a handle pipe 30, and a flexible hose 23. The extension pipe 20 may be made of a resin or metal material. The extension pipe 20 may be connected between the suction unit 21 and the handle pipe 30.

The handle pipe 30 may be connected between the extension pipe 20 and the flexible hose 23. A handle 31 and a manipulator 32 may be provided at the handle pipe 30. A user may perform cleaning while holding the handle 31. In addition, the user may manipulate buttons of the manipulator 32 to turn the cleaner on/off or adjust a suction degree.

The flexible hose 23 may be connected between the handle pipe 30 and the main body 10. The flexible hose 23 may be made of a flexible material such that the handle pipe 30 may move freely.

The suction unit 21, the extension pipe 20, the handle pipe 30, and the flexible hose 23 may communicate with each other. Air suctioned from the suction unit 21 may be introduced into the main body 10 through the extension pipe 20, the handle pipe 30, and the flexible hose 23.

The main body 10 may be provided with a suction port 13 to guide the suctioned air to the dust collector 40 and a discharge port 12 to discharge air purified by the dust collector 40. The discharge port 12 may communicate with a fan motor compartment (not shown) in which the fan motor (not shown) is mounted.

The main body 10 may be provided with a mounting unit 11, to which the dust collector 40 may be mounted. The dust collector 40 may be separatably mounted to the mounting unit 11. The dust collector 40 may separate dust from the air suctioned through the suction unit 21 and may discharge purified air through the discharge port 12.

The dust collector 40 may include an inlet 91, through which air containing dust may be introduced, and an outlet 72, through which purified air may be discharged. When the dust collector 40 is mounted to the main body 10, the inlet 91 may communicate with the suction port 13 of the main body 10 and the outlet 72 may communicate with the discharge port 12 of the main body 10.

The dust collector 40 may separate dust from air using centrifugal force generated by a swirling air current. When dust accumulates in the dust collector to some extent, the user may separate the dust collector 40 from the main body 10 and remove the dust from the dust collector 40.

The main body 10 may be mounted to the wheel assembly 50. The main body 10 may be moved on a floor by the wheel assembly 50. The wheel assembly 50 may include a frame 51 and wheels 52. The frame 51 may be connected to the main body 10 and the wheels 52 may be mounted to the frame 51. The wheels 52 may be located at opposite sides of the main body 10.

The main body 10 may be provided at the bottom thereof with a caster 60 and an auxiliary wheel 70. The caster 60 may be located at the front of the main body 10 such that the caster 60 rotates in all directions to smoothly rotate the main body 10. The main body 10 may be supported on the floor at three points by the caster 60 and the wheels 52 that may be provided at the left and right sides of the main body 10. The caster 60 may be located at the front of the bottom of the main body 10, at which the flexible hose 23 may be connected to the main body 10. When a direction of the flexible hose 23 is changed by user manipulation, the front of the main body 10 may rotate in a direction in which the flexible hose 23 is directed.

The auxiliary wheel 70 may be provided at the rear of the bottom of the main body 10. The auxiliary wheel 70 may assist the main body 10 in smooth movement by the wheel assembly 50.

Hereinafter, structures of the main body and the wheel assembly according to one or more embodiments will be described in detail with reference to the accompanying drawings.

Figure 3:
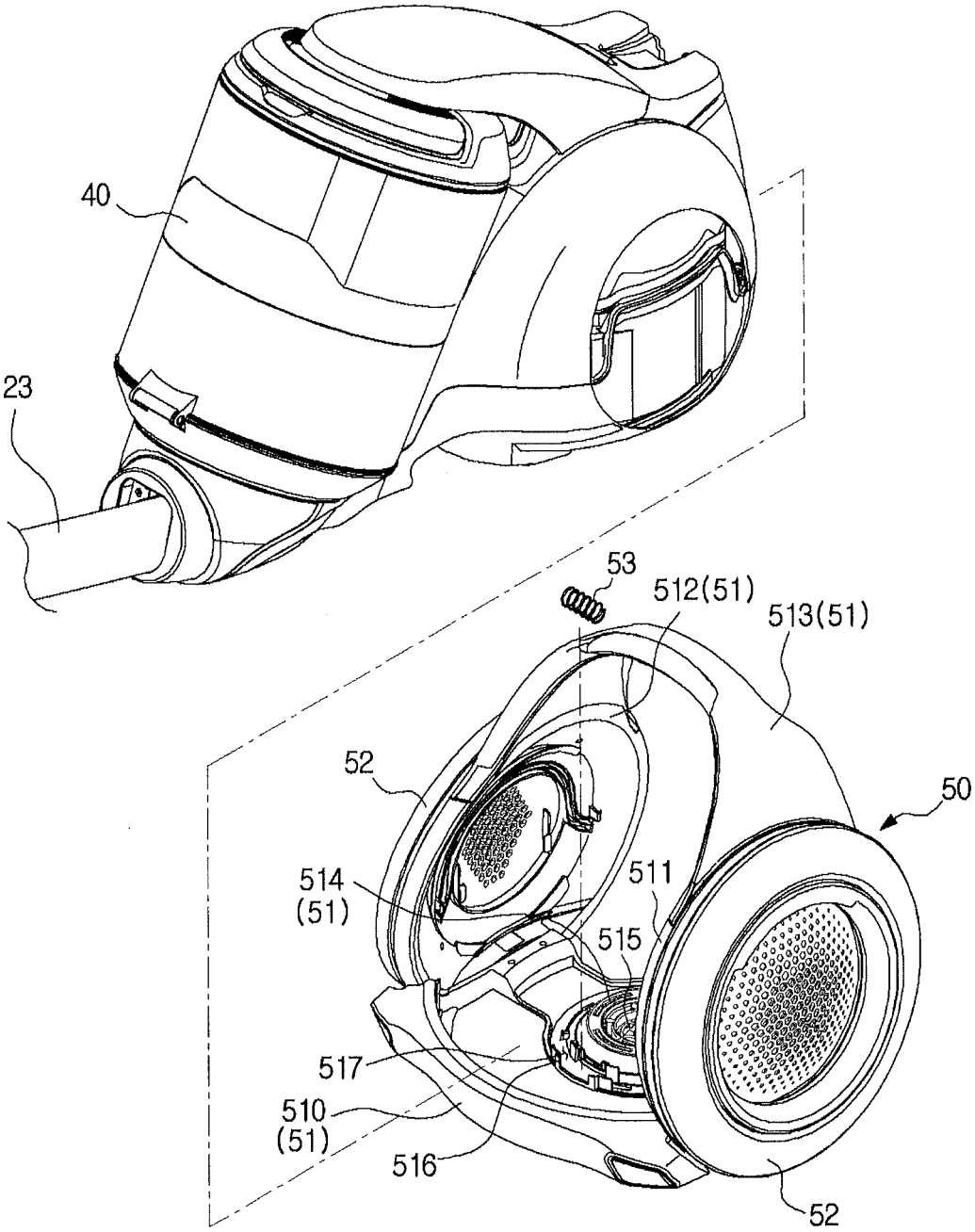
FIG. 3 is a view showing a state in which a wheel assembly is separated from the main body according to one or more embodiments.
Figure 4:
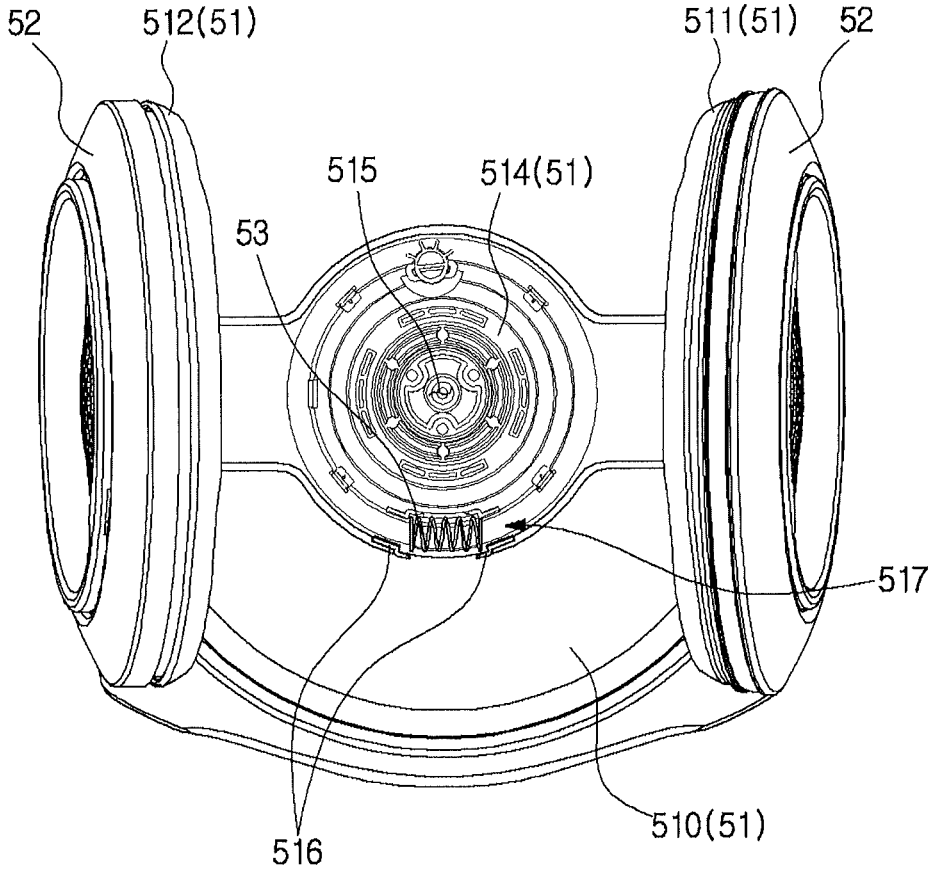
FIG. 4 is a view showing a wheel assembly according to one or more embodiments.
Figure 5:
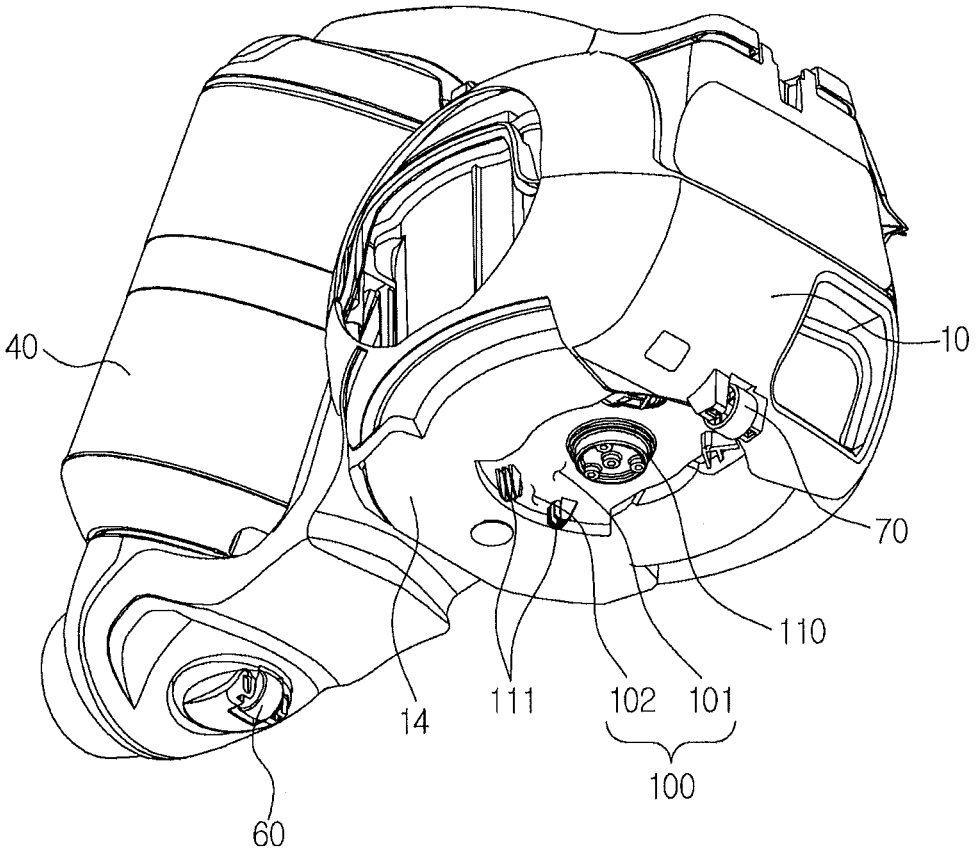
FIG. 5 is a view showing a lower part of the main body according to one or more embodiments.

FIG. 3 is a view showing a state in which the wheel assembly is separated from the main body according to one or more embodiments, FIG. 4 is a view showing the wheel assembly according to one or more embodiments, and FIG. 5 is a view showing a lower part of the main body according to one or more embodiments.

Referring to FIGS. 3 to 5, the main body 10 according to one or more embodiments may be rotatably mounted to the wheel assembly 50. The main body 10 may be moved by the wheel assembly 50. When the direction of the flexible hose 23 is changed by user manipulation during cleaning, the main body 10 may rotate in the changed direction of the flexible hose 23 independently of the wheel assembly 50.

The wheel assembly 50 may include a frame 51 and wheels 52 rotatably mounted to the frame 51. The wheels 52 may be provided at left and right sides of the main body 10 in a movement direction of the main body 10. The wheels 52 smoothly move the main body 10 in a movement direction of the flexible hose 23 connected to the main body 10.

The frame 51 may include a first frame 511 and a second frame 512, to which the wheels 52 provided at the left and right sides of the main body 10 may be mounted, and a third frame 510 that may be connected between the first frame 511 and second frame 512. The third frame 510 may be located at a lower part of a base 14 that may be provided at the bottom of the main body 10. The frame 51 may further include a fourth frame 513 that may be located at an upper part of the main body 10. The fourth frame 513 may be connected between the first frame 511 and second frame 512.

The main body 10 may rotate relative to the frame 51. The base 14 of the main body 10 and the third frame 510 may be rotatably coupled to each other via a fastening member. The main body 10 may rotate within a range of about 10 to 15 degrees, for example.

A first rotation guide 514 to guide rotation of the main body 10 may be formed at the third frame 510 in a protruding state. The first rotation guide 514 may be formed in a ring shape. The first rotation guide 514 may be inserted into a receiving unit 100, which will hereinafter be described, that may be formed at the base.

The first rotation guide 514 may be provided with a guide-receiving groove 515. A second rotation guide 110, which will hereinafter be described, formed at the base 14 may be inserted into the guide-receiving groove 515.

An elastic member 53 may be provided at one side of the third frame 510. The third frame 510 may be provided with an elastic member mounting unit 516. The elastic member 53 may be received in the elastic member mounting unit 516. The elastic member mounting unit 516 may protrude from the third frame 510. The elastic member mounting unit 516 may be located outside the first rotation guide 514.

The third frame 510 may be provided with a stopper. The elastic member mounting unit 516 protruding from the third frame 510 may function as the stopper. Alternatively, the stopper may be formed at the third frame 510 separately from the elastic member mounting unit 516 in a protruding state. The stopper may be provided at the other side of the third frame 510 separately from the elastic member mounting unit 516.

In this case, the stopper may be provided opposite to the elastic member mounting unit 516 with respect to the center of rotation of the first rotation guide 514. The distance from the center of rotation of the first rotation guide 514 to the elastic member mounting unit 516 may be equal to that from the first rotation guide 514 to the stopper.

Holes 517 may be formed at opposite sides of the elastic member mounting unit 516. Pressing units 111, which will hereinafter be described, may be formed at the base 14. The pressing units 111 may press the elastic member 53 received in the elastic member mounting unit 516 through the holes 517.

A receiving unit 100 may be formed at the base 14 that may be provided at the bottom of the main body 10. The first rotation guide 514 of the third frame 510 may be rotatably received in the receiving unit 100. The elastic member mounting unit 516 may be received in the receiving unit 100.

The receiving unit 100 may include a first receiving unit 101 and a second receiving unit 102. The first receiving unit 101 may be formed in the shape of a circle R1 that may correspond to the outer diameter of the first rotation guide 514. The second receiving unit 102 may be located outside the first receiving unit 101. Specifically, the second receiving unit 102 may be located at the front or the rear of the first receiving unit 101 such that the second receiving unit 102 may be connected to the first receiving unit 101. The receiving unit 100 may extend backward and forward with respect to the movement direction of the main body 10.

The second receiving unit 102 may be formed in the shape of a portion of a circle R2 corresponding to a movement route of the outside of the elastic member mounting unit 516 or the outside of the stopper during rotation of the base 14. That is, the inside of the receiving unit 100 forming the second receiving unit 102 may be provided to correspond to a portion of the circle R2 corresponding to the movement route of the outside of the elastic member mounting unit 516 or the outside of the stopper during rotation of the base 14, i.e. an arc of a sector having a central angle θ1. The shape of the second receiving unit formed at the pressing units 111 may correspond to that of the second receiving unit into which the stopper provided at the third frame 510 is inserted.

Since the second receiving unit 102 may not formed in the shape of the entirety of the circle R2 corresponding to the movement route of the outside of the elastic member mounting unit 516 or the outside of the stopper but may be formed in the shape of a portion of the circle R2, the side of the stopper or the elastic member mounting unit 516 may interfere with the inside of the receiving unit 100 forming the second receiving unit 102 with the result that a rotational angle of the main body may be restricted.

The second rotation guide 110 may be formed at the base 14 provided at the bottom of the main body 10 in a protruding state. The second rotation guide 110 may be a rotary shaft, about which the main body 10 may rotate. When the main body is mounted to the wheel assembly 50, the second rotation guide 110 may be inserted into the guide-receiving groove 515 formed at the third frame 510. The second rotation guide 110 may rotate in a state in which the second rotation guide 110 may be inserted into the guide-receiving groove 515.

Hereinafter, an operation of changing a movement direction of the main body 10, based on the structures of the wheel assembly 50 and the base 14, will be described.

Figure 6A:
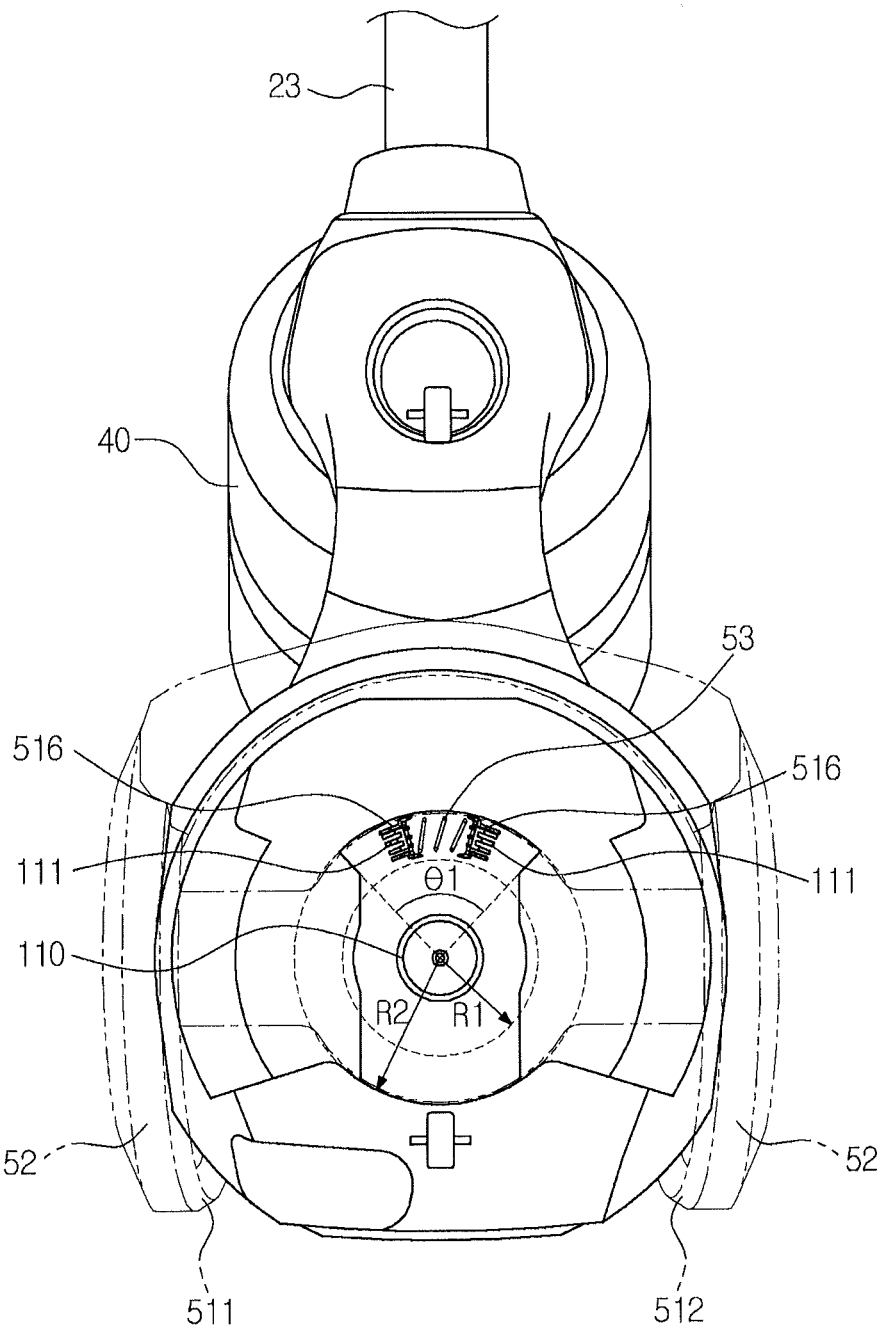
FIGS. 6A to 6C are views showing the main body according to one or more embodiments before and after rotation when viewed from below.
Figure 6B:
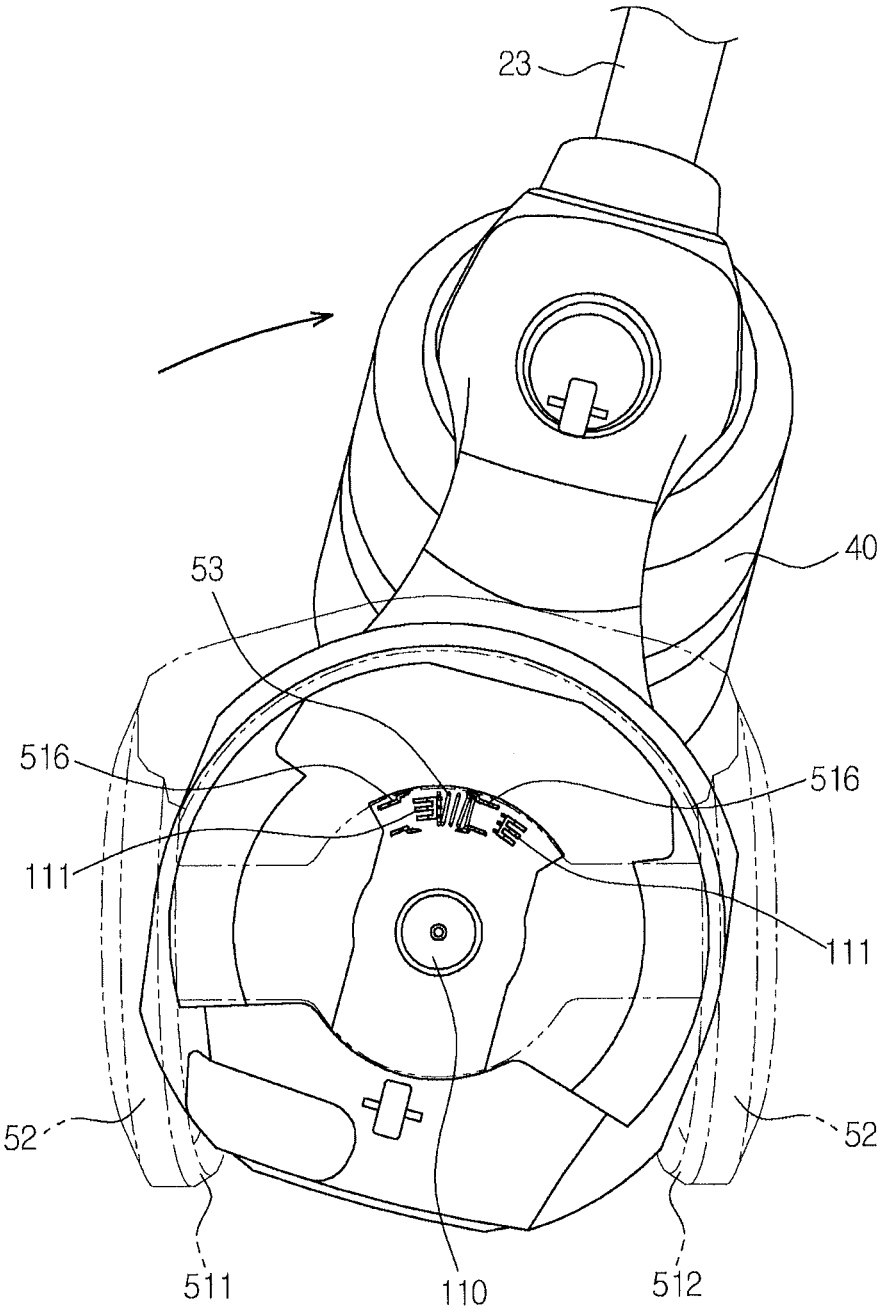
Figure 6C:
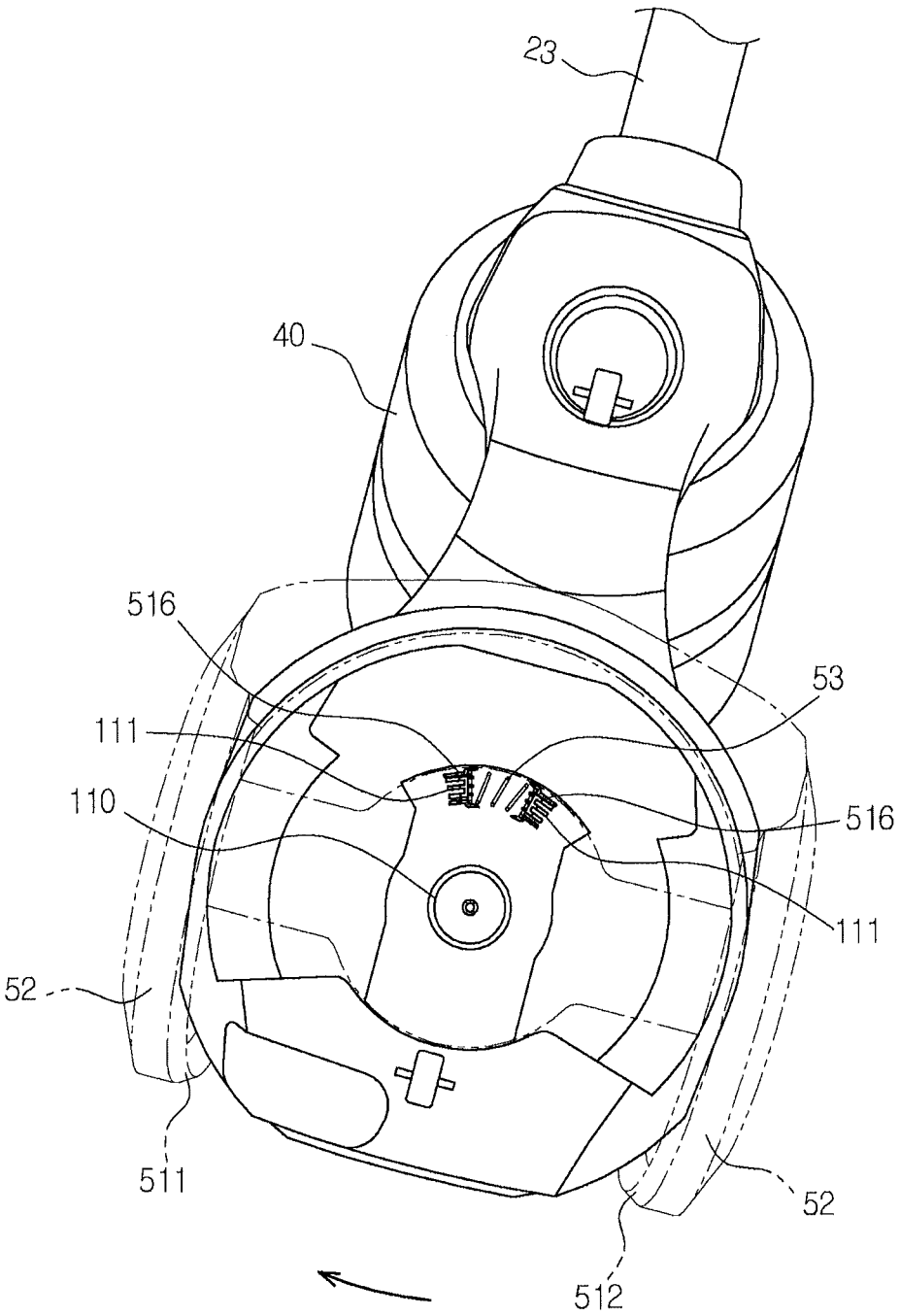
Figure 7A:
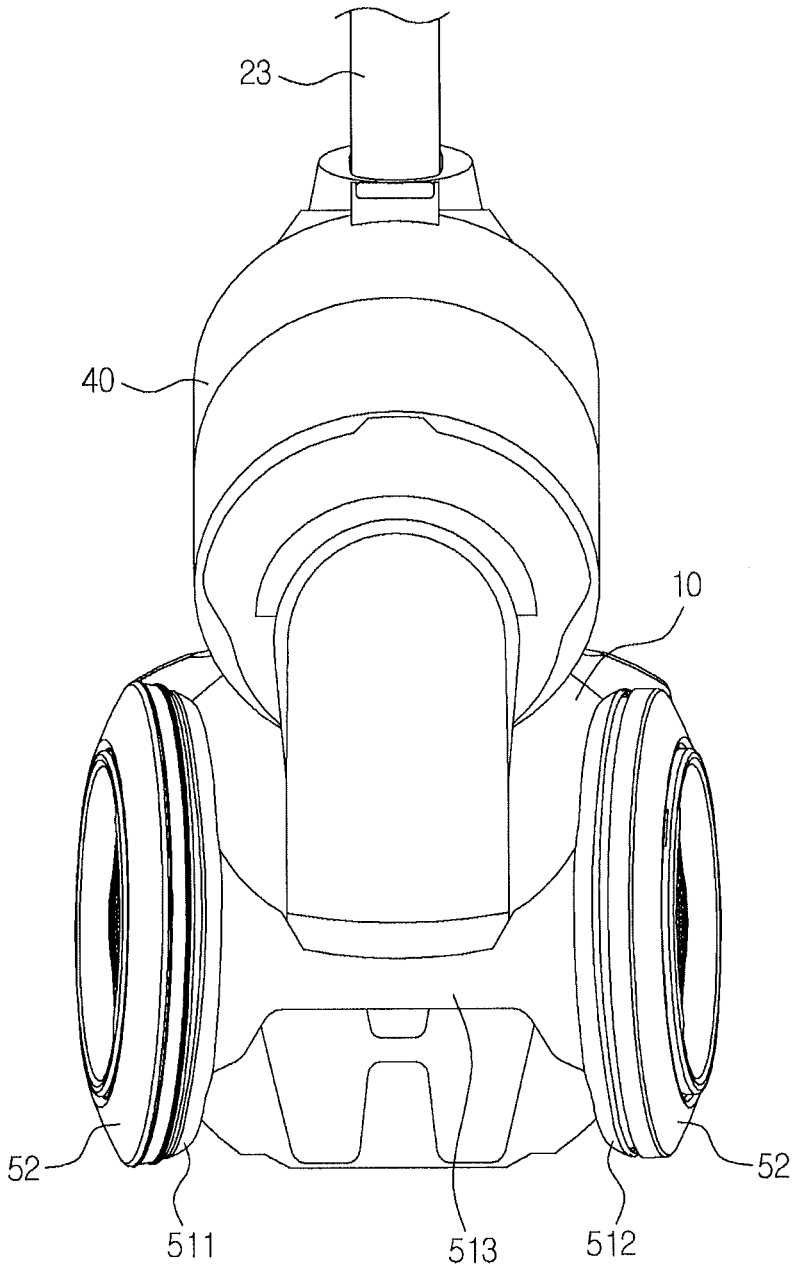
FIGS. 7A to 7C are views showing the main body according to one or more embodiments before and after rotation when viewed from above.
Figure 7B:
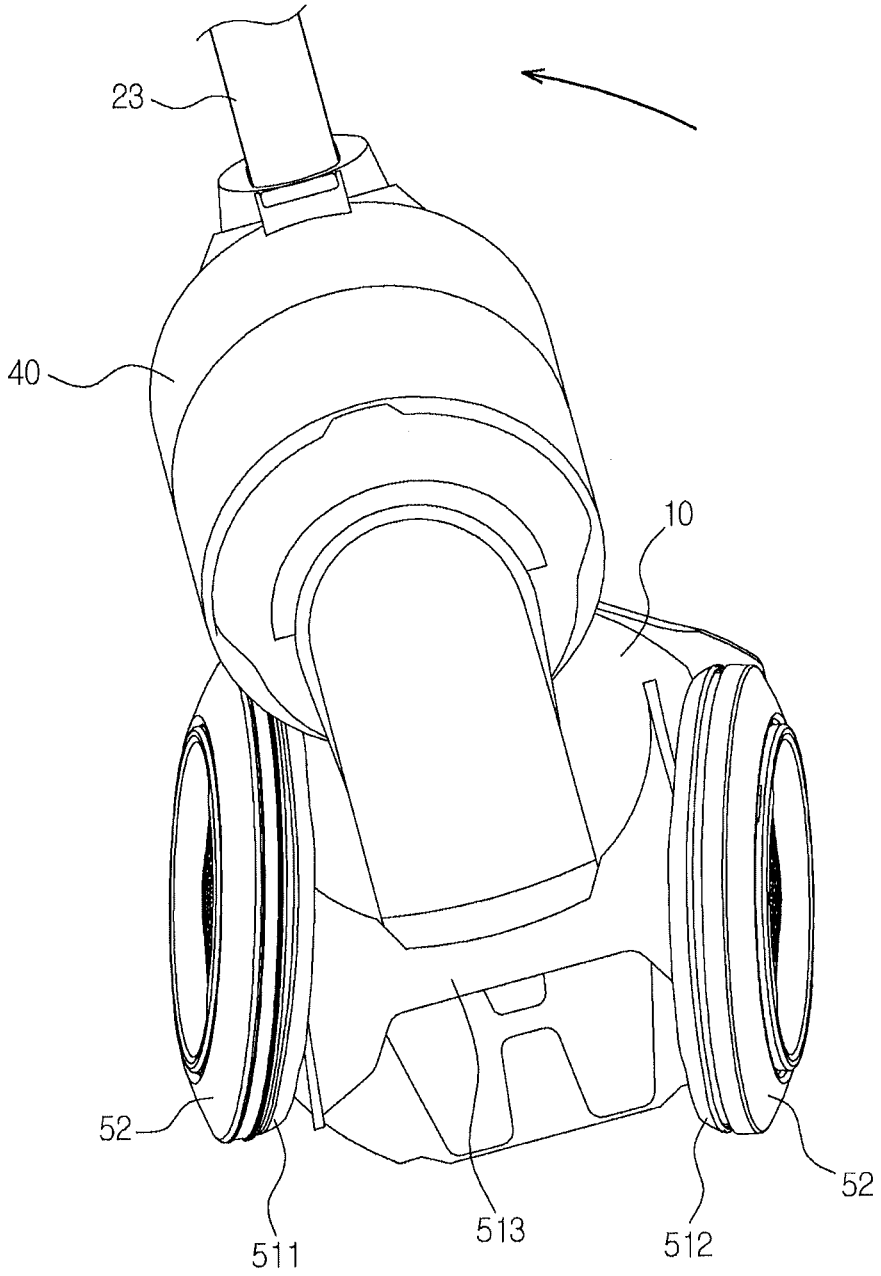
Figure 7C:
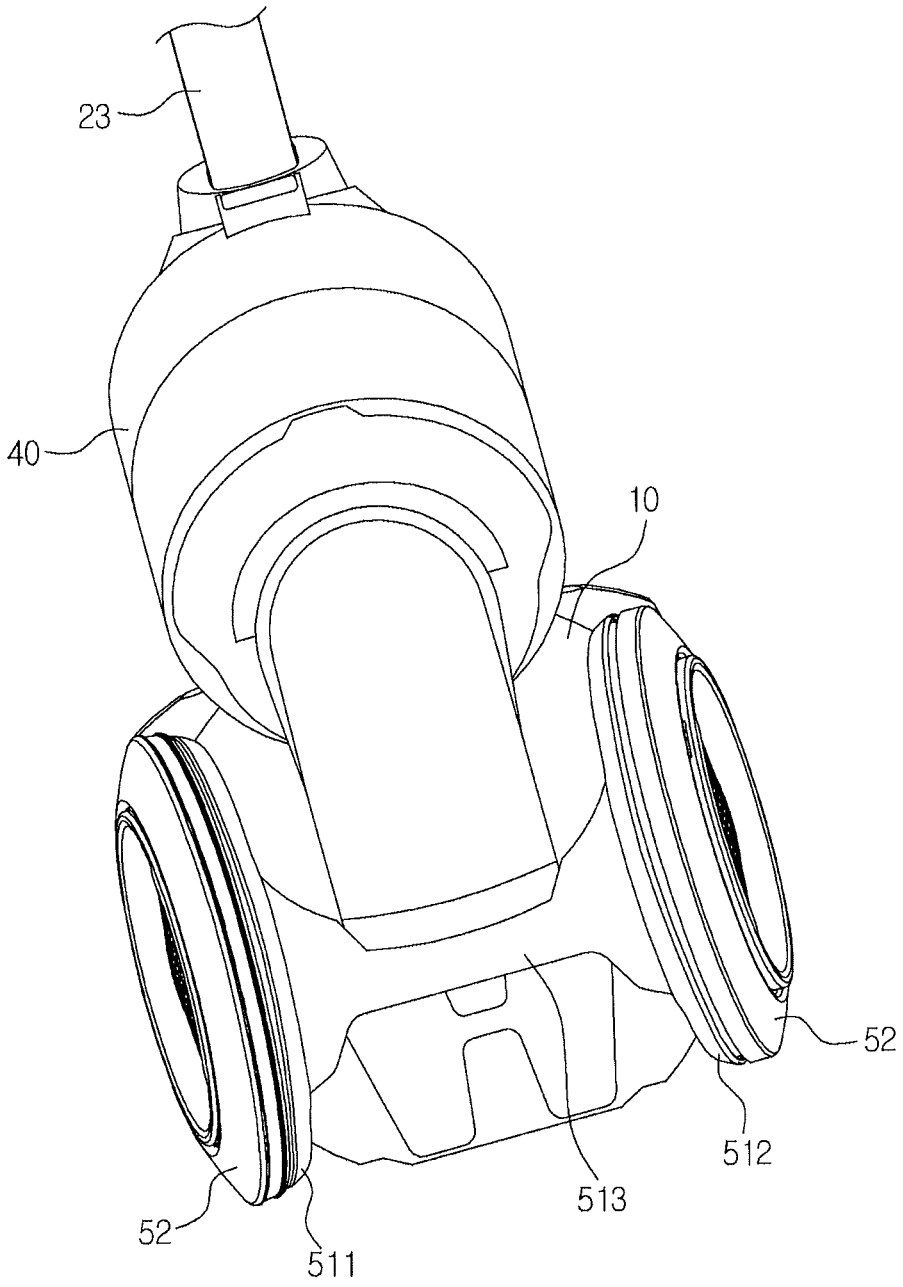
Figure 8:
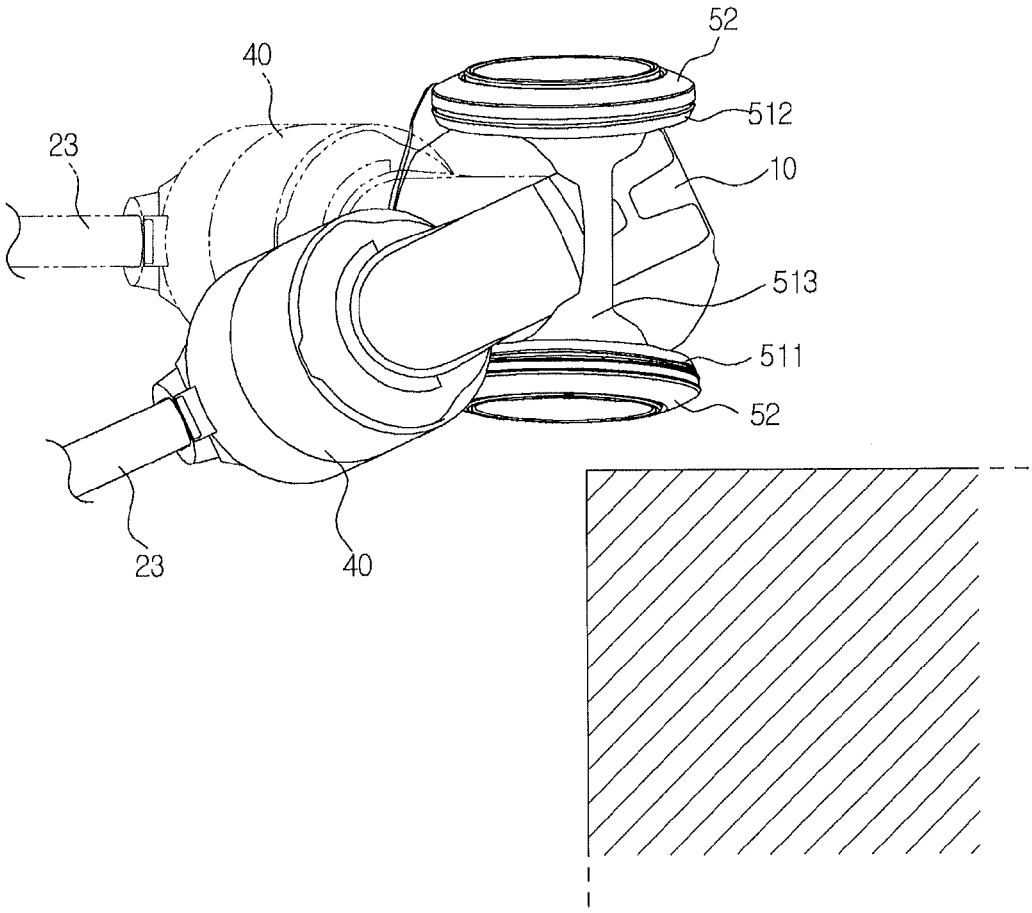
FIG. 8 is a view showing that the main body according to one or more embodiments turns at a corner and moves.

FIGS. 6A to 6C are views showing the lower part of the main body according to one or more embodiments before and after rotation, FIGS. 7A to 7C are views showing the upper part of the main body according to one or more embodiments before and after rotation, and FIG. 8 is a view showing that the main body according to one or more embodiments turns at a corner and moves.

Referring to FIGS. 6A to 8, when a movement direction of the main body 10 according to one or more embodiments is changed by the flexible hose 23, etc., the main body 10 may first rotate independently of the wheel assembly as shown in FIG. 7B. After rotation of the main body 10, the wheel assembly 50 may rotate in a direction in which the main body 10 is directed due to the elastic member 53.

As shown in FIGS. 6A and 7A, the main body 10 may move in a state in which the main body 10 is located in a forward direction. As shown in FIGS. 6A and 7A, the wheel assembly 50 may be located in the same direction as the main body 10.

When the main body 10 turns at a corner or the movement direction of the main body 10 is changed by the flexible hose 23, etc. as shown in FIG. 8, the main body 10 may first rotate in a state in which the direction of the wheel assembly 50 is not changed as shown in FIGS. 6B and 7B. At this time, the pressing units 111 provided at the base 14 of the main body 10 may press the elastic member 53 received in the elastic member mounting unit 516 through the holes 517 formed at the elastic member mounting unit 516 of the third frame 510.

When force is applied to the main body 10 in the changed movement direction of the main body 10 in a state in which the main body 10 has rotated, elastic force of the elastic member 53 may be applied to the pressing units 111 such that the pressing units 111 may return to positions before change in movement direction. As shown in FIGS. 6C and 7C, the wheel assembly 50 may rotate in the direction in which the main body 10 is directed due to the elastic force that may be applied to the pressing units 111. As a result, both the main body 10 and the wheel assembly 50 may rotate and thus the movement directions of the main body 10 and the wheel assembly 50 may be changed. In a state in which the main body 10 and the wheel assembly 50 are directed in the same direction, therefore, the main body 10 may move in the movement direction after rotation.

As described above, the main body 10 may rotate independently of the wheel assembly 50 and, after rotation of the main body 10, the wheel assembly 50 may rotate in the direction in which the main body 10 is directed due to the elastic force of the elastic member 53. Consequently, the direction of the main body 10 may be smoothly changed. When the main body 10 turns at a corner as shown in FIG. 8, the main body 10 may be prevented from being pulled or overturning and the direction of the main body 10 may be rapidly and stably changed. Consequently, straight movement of the main body 10 may be smoothly achieved by the wheel assembly 50 while rotatability of the main body 10 may be improved, thereby possibly improving user convenience and satisfaction in use.

Figure 9:
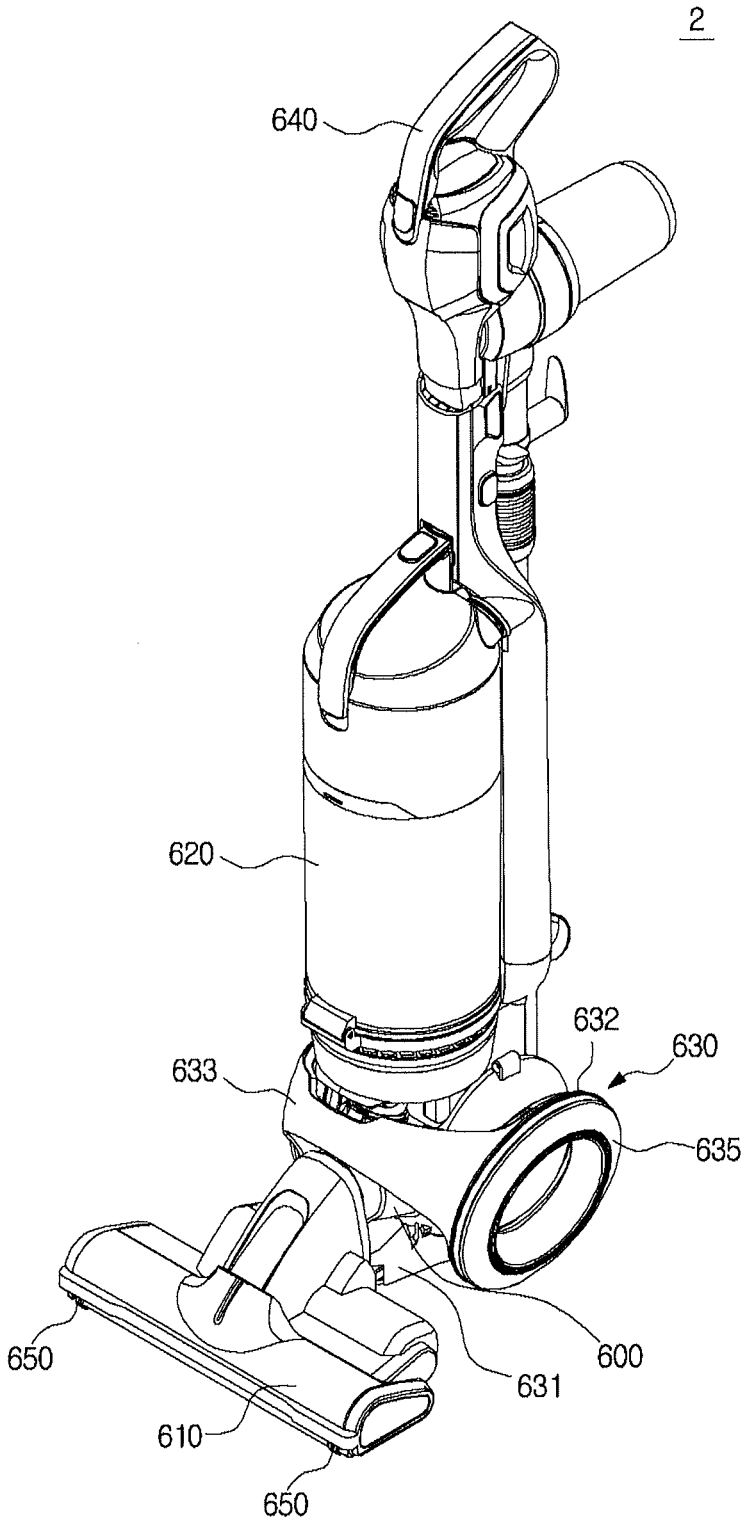
FIG. 9 is a view showing a vacuum cleaner according to one or more embodiments.
Figure 10:
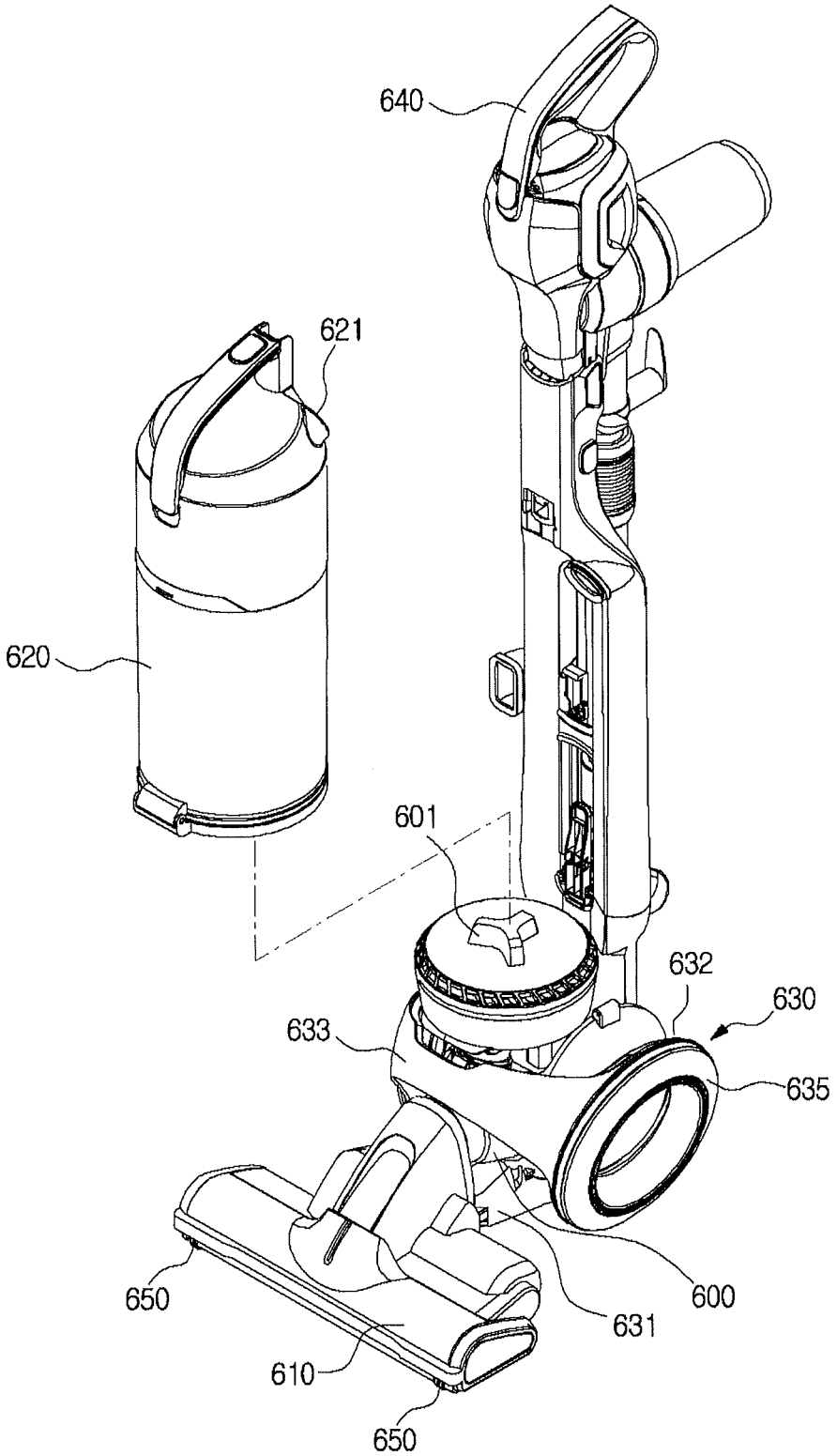
FIG. 10 is a view showing a state in which a dust collector is separated from a main body of the vacuum cleaner according to one or more embodiments.

FIG. 9 is a view showing a vacuum cleaner according to one or more embodiments and FIG. 10 is a view showing a state in which a dust collector is separated from a main body of the vacuum cleaner according to one or more embodiments.

Referring to FIGS. 9 and 10, a vacuum cleaner 2 according to one or more embodiments may be an upright type vacuum cleaner. The vacuum cleaner 2 may include a main body 600, a suction unit 610 directly connected to one side of the main body 600 to suction air and dust from a surface to be cleaned in a state of contacting the surface, a dust collector 620 mounted to the main body 600, and a wheel assembly 630. In the upright type vacuum cleaner 2, the suction unit 610 may be directly connected to the main body 600 not via an additional hose.

A fan motor (not shown) to generate suction force may be provided in the main body 600. A handle 640 may be provided at the upper side of the main body 600 such that the handle 640 may be approximately perpendicular to the main body 600. The wheel assembly 630 to move the main body 600 may be provided at the lower end of the main body 600. The suction unit 610 may be provided with a suction brush (not shown) to clean a carpet.

The main body 600 may be provided with a mounting unit 601, to which the dust collector 620 may be mounted. The dust collector 620 may be separatably mounted to mounting unit 601 provided at the main body 600.

When the dust collector 620 is mounted to the mounting unit 601, an inlet 621 of the dust collector 620 may communicate with a suction port of the main body 600 and an exhaust pipe (not shown) of the dust collector 620 may communicate with a discharge port of the main body 10.

Air suctioned by the suction unit 610 may be introduced into the dust collector 620 through the suction port of the main body 600 and the inlet 621 of the dust collector 620, purified in the dust collector 620, and discharged from the dust collector 620 through the exhaust pipe (not shown) of the dust collector 620 and the discharge port of the main body 600.

The wheel assembly 630 may be provided at the rear of the main body 600. The main body 600 may be smoothly moved on a floor by the wheel assembly 630. The main body 600 may rotate independently of the wheel assembly 630.

An auxiliary wheel unit 650 to facilitate movement of the main body 60 may be provided at the bottom of the main body 600 or the bottom of the suction unit 610. The auxiliary wheel unit 650 may be a caster rotatable in all directions.

Hereinafter, construction and operation of the main body 600 and the wheel assembly 630 according to one or more embodiments will be described with reference to the accompanying drawings.

Figure 11:
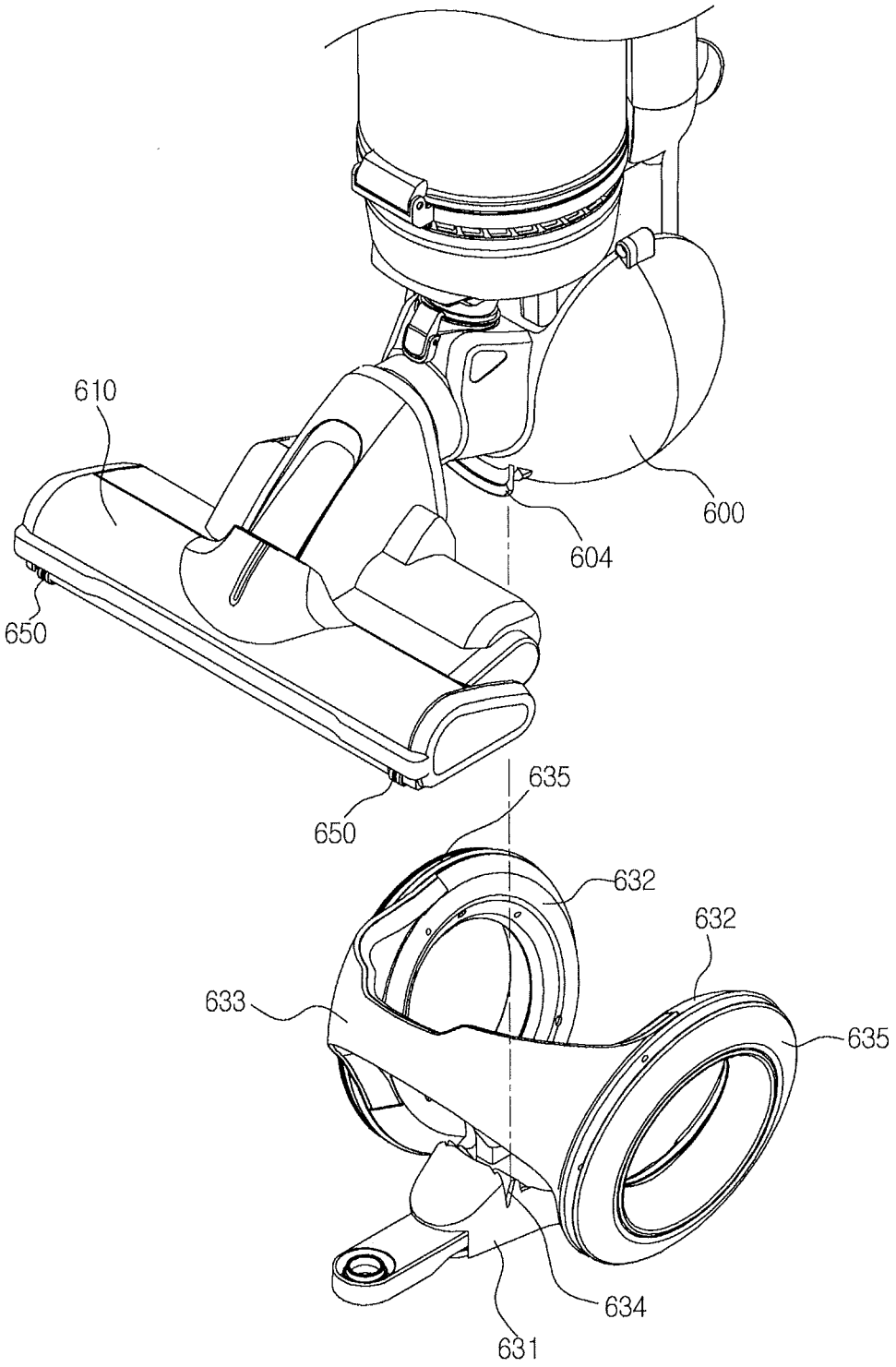
FIGS. 11 and 12 are views showing a state in which a wheel assembly is separated from the main body according to one or more embodiments.
Figure 12:
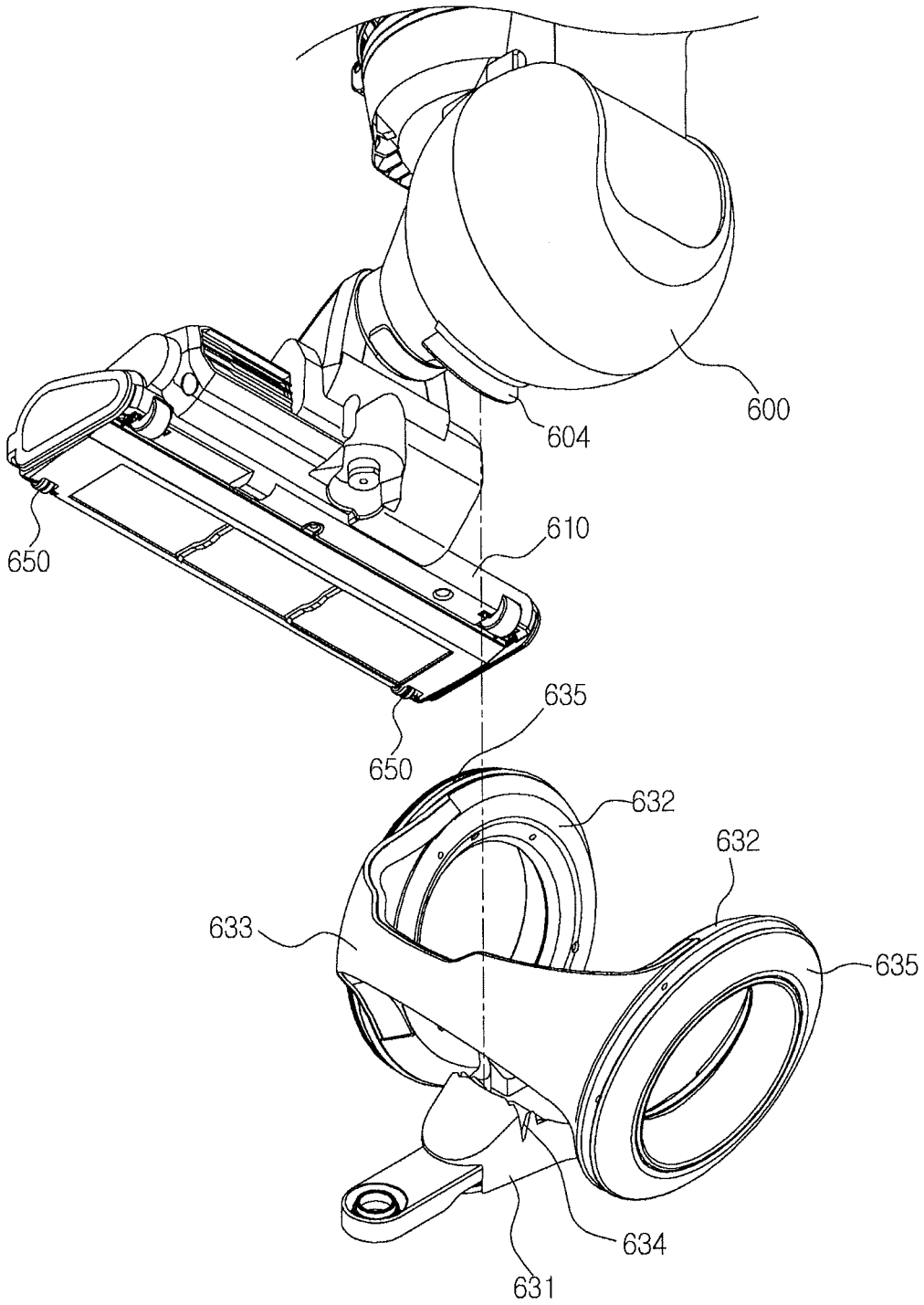

FIGS. 11 and 12 are views showing a state in which the wheel assembly is separated from the main body according to one or more embodiments.

Referring to FIGS. 11 and 12, the wheel assembly 630 may include frames 631, 632, and 633 and wheels 635. The wheels 635 may be mounted to the frames 632. The wheels 635 may be located at left and right sides of the main body 600.

The frames 631, 632, and 633 may include a first frame 631, second frames 632, and a third frame 633. The first frame 631 may be located at the lower part of the main body 600. The second frames 632 may be provided at opposite ends of the first frame 631 such that the second frames 632 are connected to the first frame 631.

In a case in which the first frame 631 is located at the lower part of the main body 600, the second frames 632 may be located at opposite sides of the main body 600. The wheels 635 may be rotatably mounted to the second frames 632. As the wheels 635 may be located at the opposite sides of the main body 600, the main body 600 may perform straight movement.

The third frame 633 may be connected between the second frames 632 located at the opposite sides of the main body 600. The third frame 633 may be located at the upper part of the main body 600.

As the first frame 631 may be located at the lower part of the main body 600, the second frames 632 may be located at opposite sides of the main body 600, and the third frame 633 may be located at the upper part of the main body 600, the main body 600 may be located in a space defined by the frames 631, 632, and 633. The frames 631, 632, and 633 may serve to hold the main body 600, which may be rotatable. The main body 600 may be rotatably placed on the first frame 631.

The main body 600 may be connected to the handle 640 such that the main body 600 may be moved along with the handle 640. When the handle 640 is rotated to the left or to the right, the main body 600 may be rotated to the left or to the right. When the handle 640 is laid down, the main body 600 may rotate in the frames 631, 632, and 633 along with the handle 640.

The main body 600 may be provided at the bottom thereof with a first rotation guide 604. The first frame 631 may be provided with a second rotation guide 634. The first rotation guide 604 may be formed at the bottom of the main body 600 in a protruding state. The first rotation guide 604 may extend toward the left and right sides of the main body 600. The first rotation guide 604 may be inserted into the second rotation guide 634 such that movement of the first rotation guide 604 is guided by the second rotation guide 634. The second rotation guide 634 may correspond to the first rotation guide 604. The second rotation guide 634 may extend toward the left and right second frames 632.

When the main body 600 is rotated to the left or the right, the first rotation guide 604 formed at the bottom of the main body 600 may be moved along the second rotation guide 634 while being guided by the second rotation guide 634 formed at the first frame 631.

Figure 13:
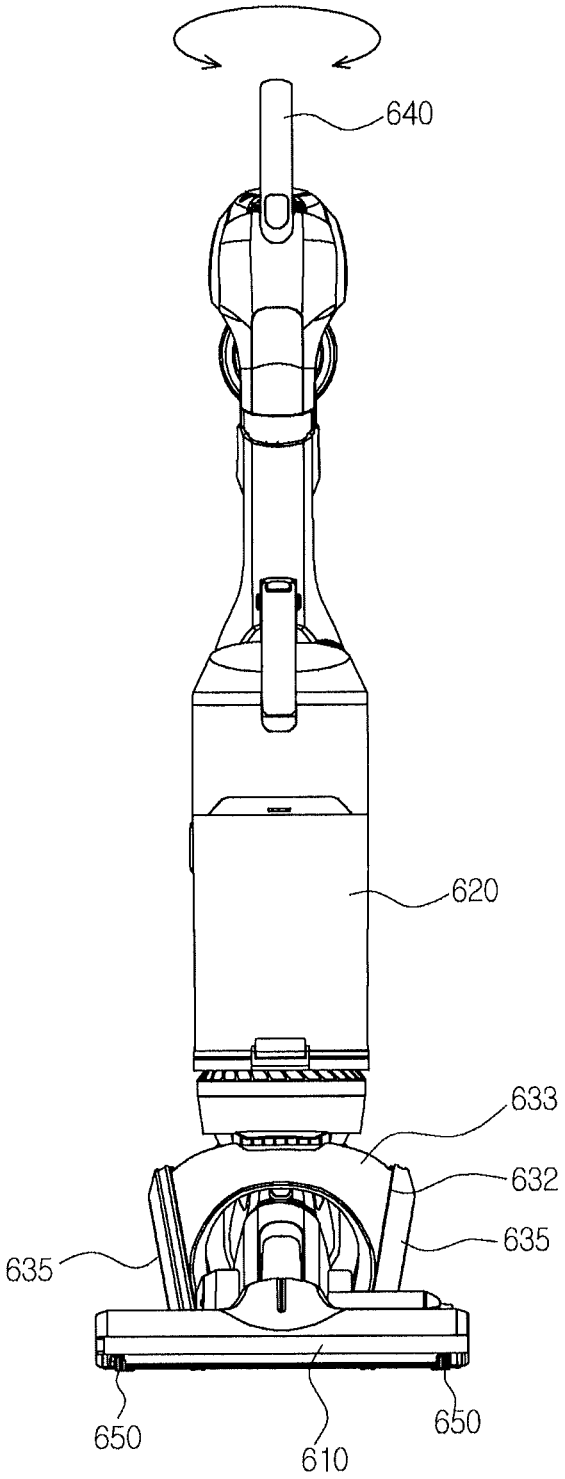
FIG. 13 is a view showing a rotational direction of a handle to rotate the vacuum cleaner according to one or more embodiments.
Figure 14A:
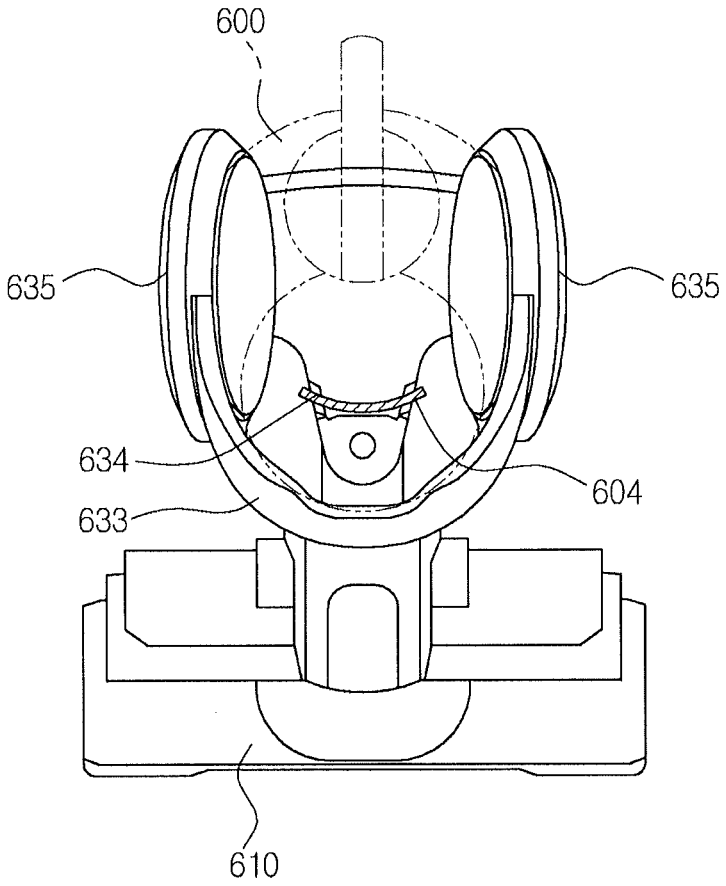
FIGS. 14A to 14C are views showing rotation of the main body according to one or more embodiments.
Figure 14B:
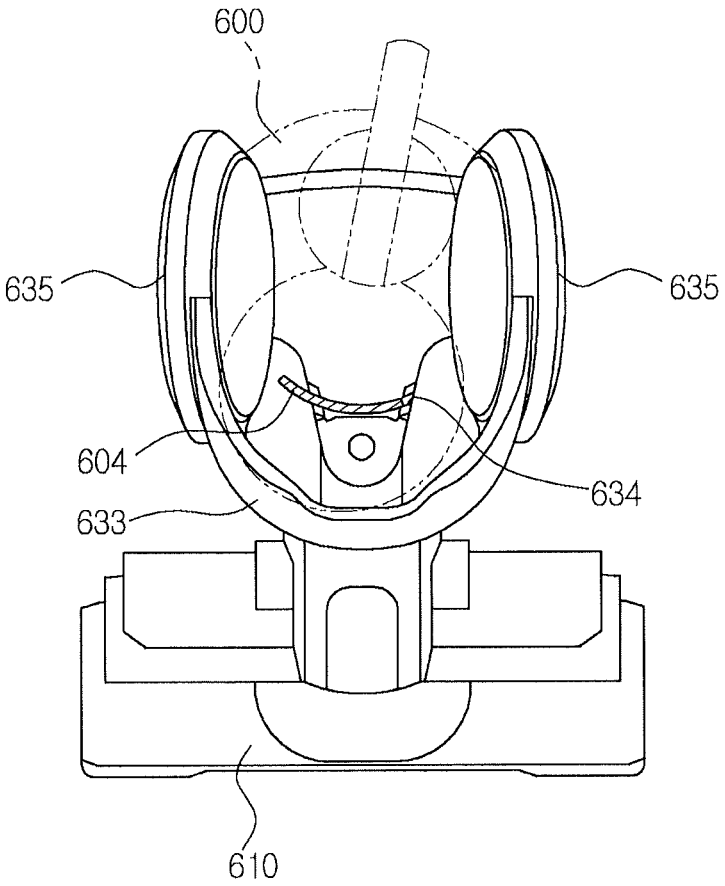
Figure 14C:
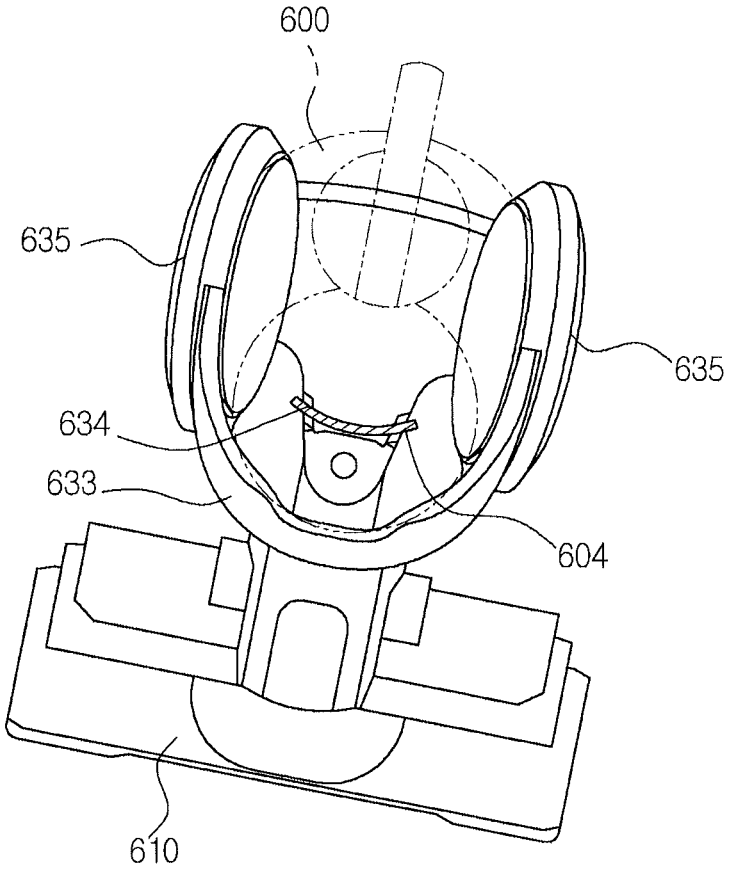

FIG. 13 is a view showing a rotational direction of the handle to rotate the vacuum cleaner according to one or more embodiments and FIGS. 14A to 14C are views showing rotation of the main body according to one or more embodiments.

Referring to FIGS. 13 and 14A to 14C, the main body 600 may rotate in the frames 631, 632, and 633 to change a movement direction of the vacuum cleaner 2. When the main body 600 rotates, the wheel assembly 630 may rotate along with the main body 600 to move the main body 600 in a direction after rotation.

When a user wishes to change the movement direction of the vacuum cleaner 2 to the left with respect to an advancing direction of the vacuum cleaner 2 during cleaning, the user may rotate the handle 640 in a counterclockwise direction. When the handle 640 rotates in the counterclockwise direction, the main body 600 connected to the handle 640 may rotate in the counterclockwise direction.

As the main body 600 rotates in the counterclockwise direction, the first rotation guide 604 provided at the bottom of the main body 600 may move along the second rotation guide 634 provided at the first frame 631.

When the main body 600 rotates in the counterclockwise direction, the suction unit 610 may rotate along with the main body 600 in the counterclockwise direction. As a result, the suction unit 610 may be directed to the left in the movement direction before rotation. After the movement direction of the vacuum cleaner 2 is changed to the left in the movement direction before rotation as described above, the vacuum cleaner 2 may continue to move.

In a case in which the movement direction of the vacuum cleaner 2 is changed to the right, a procedure similar to the case in which the movement direction of the vacuum cleaner 2 is changed to the left as described above may be applied. In order to change the movement direction of the vacuum cleaner 2 to the right, the user may rotate the handle 640 in a clockwise direction. When the handle 640 rotates in the clockwise direction, the main body 600 connected to the handle 640 and the suction unit 610 connected to the main body 600 may rotate in the clockwise direction. As a result, the suction unit 610 may be directed to the right in the movement direction before rotation. After the movement direction of the vacuum cleaner 2 is changed to the right in the movement direction before rotation as described above, the vacuum cleaner 2 may continue to move.

Change in movement direction of the vacuum cleaner 2 may be achieved during movement of the vacuum cleaner 2 and cleaning. After movement of the vacuum cleaner 2, the handle 640 may be rotated to change the movement direction of the vacuum cleaner 2 and then the vacuum cleaner 2 may move in the changed direction. In addition, the handle 640 may be rotated in a desired direction during straight movement of the vacuum cleaner 2 to achieve the change in movement direction of the vacuum cleaner 2.

The straight movement of the upright type vacuum cleaner may be smoothly achieved and, in addition, the movement direction of the vacuum cleaner may be smoothly changed through the structure as described above. Consequently, user convenience may be improved.

As is apparent from the above description, the vacuum cleaner according to one or more embodiments may be configured such that the wheels may be provided at the left and right sides of the main body. Consequently, straight movement of the vacuum cleaner may be performed. In addition, the main body may first rotate independently of the wheels during a change in direction of the vacuum cleaner and then the wheels may rotate in a direction in which the main body is directed and move. Consequently, the movement direction of the vacuum cleaner may be changed.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A vacuum cleaner comprising:

a main body comprising a fan motor to generate suction force;

a suction unit connected to the main body to suction foreign matter from a surface to be cleaned in a state of contacting the surface;

a dust collector separatably mounted to the main body to separate and collect foreign matter from air suctioned by the suction unit; and a wheel assembly to move the main body, wherein the main body is rotatable independently of the wheel assembly such that the main body rotates in response to a change in a driving direction thereof, and the wheel assembly rotates, in response to the rotation of the main body, to change its direction to which the main body is directed.

2. The vacuum cleaner according to claim 1, further comprising:

an elastic member disposed between the wheel assembly and the main body, wherein when the main body rotates to change the driving direction thereof, a direction of the wheel assembly is changed by elastic force of the elastic member.

3. The vacuum cleaner according to claim 1, wherein the wheel assembly comprises:

a lower frame provided at a lower part of the main body;

left and right frames provided at left and right sides of the main body, respectively; and wheels rotatably mounted to the left and right frames, the wheels being provided at opposite sides of the main body.

4. The vacuum cleaner according to claim 3, wherein the lower frame comprises a first rotation guide in a protruding state.

5. The vacuum cleaner according to claim 4, wherein the main body comprises at a bottom thereof a receiving unit to receive the first rotation guide.

6. The vacuum cleaner according to claim 5, wherein the receiving unit comprises at an inside thereof a second rotation guide in a protruding state, the second rotation guide functioning as a rotary shaft of the main body.

7. The vacuum cleaner according to claim 6, wherein the lower frame comprises a guide-receiving groove, into which the second rotation guide is inserted.

8. The vacuum cleaner according to claim 7, wherein the guide-receiving groove is formed at the first rotation guide and the second rotation guide is rotatably inserted into the guide-receiving groove.

9. The vacuum cleaner according to claim 5, wherein the receiving unit is formed at the bottom of the main body such that the receiving unit extends backward and forward.

10. The vacuum cleaner according to claim 3, wherein the lower frame comprises an elastic member.

11. The vacuum cleaner according to claim 10, wherein the main body comprises at a bottom thereof a pressing unit to press the elastic member.

12. The vacuum cleaner according to claim 11, wherein the pressing unit presses the elastic member when the main body rotates to change the driving direction of the main body.

13. The vacuum cleaner according to claim 12, wherein the wheel assembly is rotated in a direction in which the main body is directed by elastic force of the elastic member.

14. The vacuum cleaner according to claim 11, wherein the lower frame comprises an elastic member mounting unit to receive the elastic member.

15. The vacuum cleaner according to claim 14, wherein the elastic member mounting unit comprises a hole at a side thereof, through which the pressing unit presses the elastic member.

16. The vacuum cleaner according to claim 11, wherein the pressing unit is provided in a receiving unit formed at the bottom of the main body.

17. The vacuum cleaner according to claim 16, wherein an inside of the receiving unit interferes with the elastic member mounting unit or a stopper provided at the lower frame to restrict a rotational angle of the main body.

18. The vacuum cleaner according to claim 3, further comprising:

a handle connected to an upper side of the main body such that the handle is perpendicular to the main body, wherein the suction unit is directly connected to one side of the main body.

19. The vacuum cleaner according to claim 18, wherein the main body comprises at a bottom thereof a first rotation guide extending toward the left and right sides of the main body.

20. The vacuum cleaner according to claim 19, wherein the lower frame comprises a second rotation guide to guide movement of the first rotation guide.

21. The vacuum cleaner according to claim 20, wherein, when the main body rotates according to manipulation of the handle, the suction unit rotates along with the main body.

22. The vacuum cleaner according to claim 21, wherein, when the main body rotates, the first rotation guide moves in the rotated direction along the second rotation guide.

23. The vacuum cleaner according to claim 22, wherein, when the main body rotates to change the driving direction of the main body, the driving direction of the wheel assembly is changed to move the main body.

24. The vacuum cleaner according to claim 1, wherein the main body is rotatable within a range of about 10 to 15 degrees.

25. A vacuum cleaner comprising:

a main body; and a wheel assembly, to which the main body is rotatably mounted, to move the main body, wherein the main body is rotatable independently of the wheel assembly such that the main body rotates in response to a change in a driving direction thereof, and the wheel assembly rotates, in response to the rotation of the main body, to change its direction to which the main body is directed.

26. The vacuum cleaner according to claim 25, wherein the wheel assembly comprises a lower frame provided at a lower part of the main body.

27. The vacuum cleaner according to claim 26, further comprising:

a handle connected to an upper side of the main body such that the handle is perpendicular to the main body.

28. The vacuum cleaner according to claim 27, wherein the main body comprises at a bottom thereof a first rotation guide extending toward the left and right sides of the main body.

29. The vacuum cleaner according to claim 28, wherein the lower frame comprises a second rotation guide to guide driving of the first rotation guide.

30. The vacuum cleaner according to claim 29, wherein, when the main body rotates according to manipulation of the handle, the suction unit rotates along with the main body.

31. The vacuum cleaner according to claim 30, wherein, when the main body rotates, the first rotation guide moves in the rotated direction along the second rotation guide.

32. The vacuum cleaner according to claim 31, wherein, when the main body rotates to change the driving direction of the main body, the driving direction of the wheel assembly is changed to move the main body.

* * * * *